US006923590B2

(12) United States Patent
Ward, Jr. et al.

(10) Patent No.: US 6,923,590 B2
(45) **Date of Patent: *Aug. 2, 2005**

(54) PAPER BINDING STRUCTURE AND METHOD OF FORMING SAME

(76) Inventors: Thomas V. Ward, Jr., 412 Ravine Rd., Hinsdale, IL (US) 60521; Jeanne M. Ward, 334 Parkview, Elmhurst, IL (US) 60126

( * ) Notice: Subject to any disclaimer, the term of this patent is extended or adjusted under 35 U.S.C. 154(b) by 40 days.

This patent is subject to a terminal disclaimer.

(21) Appl. No.: 10/740,281

(22) Filed: Dec. 18, 2003

(65) Prior Publication Data

US 2005/0135872 A1 Jun. 23, 2005

(51) Int. Cl.[7] ..... B42F 3/00; B42F 13/12

(52) U.S. Cl. ..... 402/70; 281/15.1; 281/21.1; 281/29; 281/36; 281/37; 281/38; 281/51; 402/73; 402/74; 402/80 R; 24/67 R; 24/67 P; D19/26; D19/33

(58) Field of Search ..... 281/15.1, 21.1, 281/29, 36, 37, 38, 51; 402/70, 73, 74, 80 R; D19/26, 33; 24/67 R, 67 P

(56) References Cited

U.S. PATENT DOCUMENTS

| | | | | | |
|---|---|---|---|---|---|
| 4,548,426 | A | * | 10/1985 | Lockhart | 281/29 |
| 4,765,485 | A | * | 8/1988 | Perkins | 229/315 |
| 4,941,804 | A | * | 7/1990 | Sarpy, Jr. | 412/7 |
| 5,713,604 | A | | 2/1998 | Ward, Jr. | |
| 6,000,873 | A | * | 12/1999 | Burton | 402/75 |
| 6,149,200 | A | | 11/2000 | Lockhart | |
| 6,371,679 | B1 | * | 4/2002 | Peleman | 402/73 |
| 6,386,784 | B1 | * | 5/2002 | Ruble | 402/60 |
| 6,682,248 | B2 | * | 1/2004 | Lockhart | 402/73 |
| 2004/0120754 | A1 | * | 6/2004 | Lockhart | 402/73 |

FOREIGN PATENT DOCUMENTS

| | | |
|---|---|---|
| GB | 217128 | * 12/1924 |
| GB | 1340728 | * 12/1973 |

* cited by examiner

*Primary Examiner*—A. L. Wellington
*Assistant Examiner*—Mark T. Henderson
(74) *Attorney, Agent, or Firm*—Meroni & Meroni, P.C.; Charles F. Meroni, Jr.; Paul Derek Pressley

(57) ABSTRACT

A binding structure for binding together sheets of paper having multiple openings along a margin thereof is provided. The structure comprises a male connector panel having multiple openings along its edge and a female connector panel fastened to the back panel of a one-piece report cover by means of adhesive, extending adjacent and parallel to the second hinge and distanced to allow enough room for the tab-shape on the male connector panel to be inserted to the center opening of the female connector panel without interfering with the adhesion of the female connector panel to the back panel of the cover. An elongated binding element is provided extending adjacent and parallel to the margin of the sheets of paper and the male connector panel edge. The male connector panel is disposed on a bottom side of the elongated binding element. A one-piece report cover is provided having a front panel, a center spine panel, a back panel, a first hinge and a second hinge. The first and second hinges are formed integral with the one piece cover and define pivotal connections between the front panel, the center spine panel and the back panel. The front panel is pivotal along the first hinge and second hinge so that the front panel is pivotally position able on top of the sheets of paper when in a closed position. The front panel, the back panel, and the sheets of paper are approximately parallel to one another allowing the structure to lay substantially flat.

25 Claims, 7 Drawing Sheets

10
19
17
20
13
8
9
7
104
12
100
6
5
103
102
24
101
48

PAPER BINDING STRUCTURE AND METHOD OF FORMING SAME

BACKGROUND OF THE INVENTION

1. Field of the Invention

The present invention relates to a paper binding structure for holding sheets of a document together. More particularly, the invention pertains to an improved paper binding structure having a paper binding member enclosed within a report cover and interlocking connector panels for optional removal of the report and for maintaining the report cover and pages bound therein substantially flat.

2. Description of the Prior Art

Various prior binding devices are known in the art. Permanent binding devices are commonly used to produce hard cover books. Semi-permanent binding devices which use metal or plastic binding structures are commonly used when binding together the internal pages of a document and a front and back cover. This binding procedure requires numerous holes to be punched in the margins of the pages to be bound. The binding member of the binding devices engages the holes to secure the pages together. A third type of binding is known as loose leaf binding which is typically associated with three-ring binders.

In producing professional documents, such as business reports and proposals, semi-permanent binding devices are found to be a favorable choice. These binding devices are readily available at a low cost and allow for secure holding of pages while at the same time being releasable wherein the pages can be replaced or updated prior to distribution. A main disadvantage with semi-permanent binding devices involves an unprofessional appearance conveyed by the binding members. The exposed unprotected metal or plastic binding device is unpreventable for many types of use.

Several attempts have been made in the art to construct semi-permanent binding devices having report covers connected thereto which will conceal the binding element and to produce an improved appearance. For example, U.S. Pat. No. 4,941,804 issued to Sarpy, discloses a plastic multi-ring paper binding system using a one piece cover. A plastic ring-type binder binds together sheets of paper along a margin. One or more elongated adhesive bead members extend along the binder to connect the binder to the center of a one piece cover. While this device serves to provide a satisfactory binding device, it suffers from the clear disadvantages of having the cover connected to the binder prior to the binding process.

U.S. Pat. No. 4,548,426 issued to Lockhart, discloses a report cover for binding a document. The report cover includes a front panel having three parallel hinges and a rear panel having a single hinge. The sheets of paper making up the report are secured between the front and rear panels near the first edges of the panels by staples. The front panel is then folded about the hinges to lie parallel to and adjacent the rear panel. The front and rear panels are secured along a line distant from the first hinge by an adhesive strip. This device serves to provide a unique binding solution, but it suffers from several disadvantages. This device does not employ the use of a plastic or metal semi-permanent binding device, but instead uses staples. The use of semi-permanent binding devices has been found to be especially cost effective, as well as providing for an easy way to make sheet insertions or deletions without having to use staples which are known to damage paper after repeated use within the same sheets of paper. Furthermore, in this device the first hinges of each panel permits certain portions of the panels and report to pivot about the hinges to attempt to eliminate any force tending to open or close the report. However, the sheets of the report are connected to the device at an angle which prevents the sheets from laying flat and instead causes a curve or bulge in the document pages.

U.S. Pat. No. 6,149,200 issued to Lockhart discloses another device having a full page bound to the back of the report with a binding device, normally plastic or metal. The provided cover is actually a 3-section tri-fold with a flap on the top and bottom of the middle section and a side flap on the end of the right-hand section. The right-hand section folds in to the middle section to create a pocket. The full page then slips inside the pocket loosely holding the report in place. There are several disadvantages to this system. The most prominent is the lack of any true security for the protection of the document. When turned down, the report drops out of the pocket easily. Also, the system is not cost effective, significantly increasing the amount of paper used in the original cover. Cosmetically, it appears awkward and cumbersome. It does not look efficient and, accordingly, not professional.

In working to provide a solution to the problems described in the prior art above, U.S. Pat. No. 5,713,604 was issued for a Paper Binding Structure and Method of Forming Same. In this structure, a connector panel is fastened within a one piece report cover having multiple openings for receive a binding element which holds sheets of paper therein. This structure achieved the goals of providing a low cost, professional appearing report holding device. However, it is difficult to disassemble an assembled structure of this type. The claimed invention provides an improved structure that allows for easy disassembly without potential damage to the report pages or structural elements of the cover so that the structure may be reassembled for future use.

As will be described in greater detail hereinafter, the binding structure of the present invention differs from those previously proposed and employs a number of novel features that render it highly advantageous over the aforementioned prior art.

SUMMARY OF THE INVENTION

Accordingly, it is an object of the claimed invention to provide a binding structure having an improved appearance by virtue of the binding element being concealed by an outer cover.

It is another object of the claimed invention to provide a binding structure which has sheets that lay substantially flat when in an open or closed position to provide a professional appearance, as well as to aid in stacking, mailing and handling.

It is a further object of the claimed invention to provide a cost effective binding structure having an improved appearance that can utilize existing binding equipment.

It is an even further object of the claimed invention to provide a binding structure that requires very little time to assemble and does not dramatically change the binding operation.

Still another object of the claimed invention is to provide a binding structure that secures and protects the enclosure appropriately and is removable and reusable without causing damage to the cover or any of the binding elements.

To achieve the foregoing and other objectives, and in accordance with the purposes of the claimed invention, a binding structure for binding together sheets of paper having multiple openings along a margin thereof is provided. The binding structure generally comprises a one-piece report cover, an elongated binding element, a male connector panel and a female connector panel.

The one-piece report cover has a front panel, a center spine panel and a back panel connected by a pair of parallel hinges defining pivotal connections between the panels. The one-piece cover is preferably formed of a stiff paper with the parallel hinges being formed by conventional methods such as scoring or creasing.

The elongated binding element is provided to bind sheets of paper together. The binding element typically takes the form of a plurality of flexible ring-type binders of conventional design or as a plastic bar and pin type binding structure commercially known as QUICKBIND or VELOBIND, or as a two-prong metal fastener.

The male connector panel has a rectangular shaped edge with a plurality of openings for binding in the elongated binding element and a tab shaped portion defined by upper and lower locking corners that interlock with the female connector panel. The male connector panel also preferably has a rounded corner adjacent the lower locking notch and an angled corner adjacent the upper locking notch to provide clearance for easy insertion of the male connector panel into the aperture of the female connector panel.

The female connector panel has an aperture for receiving the tab shaped portion of the male connector panel where the locking corners of the male connector panel engage the edges of the aperture to retain the male connector panel adjacent the female connector panel. The female connector panel also preferably has adhesive strips for adhering the female connector panel to the back panel of the one-piece report cover.

When assembled, the male connector panel is bound in the elongated binding element through the plurality of opening along the straight edge of the panel underneath the sheets of paper comprising the report. The tab shaped portion of the male connector panel is inserted through the aperture of the female connector panel such that the upper and lower locking corners of the male connector panel engage the edges of the aperture of the female connector panel that is adhered to the back panel of the one-piece report cover thereby retaining the male connector panel in place. The resulting binding structure provides a low cost professional appearing document that may be easily assembled and disassembled without damaging any portion of the binding structure or pages bound by the binding structure.

In another embodiment of the claimed invention, the female connector panel is an integral part of the one-piece report cover that is integral hingedly connected to the back panel of the report cover. The location of this female connector panel could be to the right of the back panel, or on top or beneath the back panel. During assembly, the female connector panel is pivoted about the hinge connecting the female connector panel to the back panel so that it overlies the back panel of the one-piece report cover. Adhesive strips are utilized to adhere the female connector panel to the back panel. The male connector panel is then assembled as previously explained.

A method of forming the binding structure is also claimed. The method comprises the steps of cutting a plurality of apertures along a first edge of a male connector panel, cutting an upper locking notch in an edge of the male connector panel perpendicular to the first edge of the male connector panel, cutting a lower locking notch in an edge opposite the edge of the male connector panel having the upper locking notch and cutting an aperture through a female connector panel. The method further includes the step of adhering the female connector panel to a panel of a report cover.

A method of assembling a document and a paper binding structure is also claimed. The method comprises the steps of engaging binding members of an elongated binding element with a plurality of apertures along a first edge of a male connector panel, engaging the binding members of the elongated binding element with a plurality of apertures along an edge of a document, inserting an upper locking corner of the male connector panel at an angle through an aperture of a female connector panel such that the upper locking corner lies beneath the female connector panel, rotating the male connector panel such that an upper locking notch in the male connector panel engages an edge of the aperture through the female connector panel, moving the male connector panel such that a bottom end of the upper locking notch contacts the edge of the aperture through the female connector panel, inserting a lower locking corner of the male connector panel through the aperture of the female connector panel, and moving the male connector panel such that a top end of the lower locking notch contacts a second edge of the aperture through the female connector panel.

Other objects, features and advantages of the invention will become more readily apparent upon reference to the following description when taken in conjunction with the accompanying drawings, which drawings illustrate several embodiments of the invention.

DETAILED DESCRIPTION OF THE PREFERRED EMBODIMENT

Figure 1:
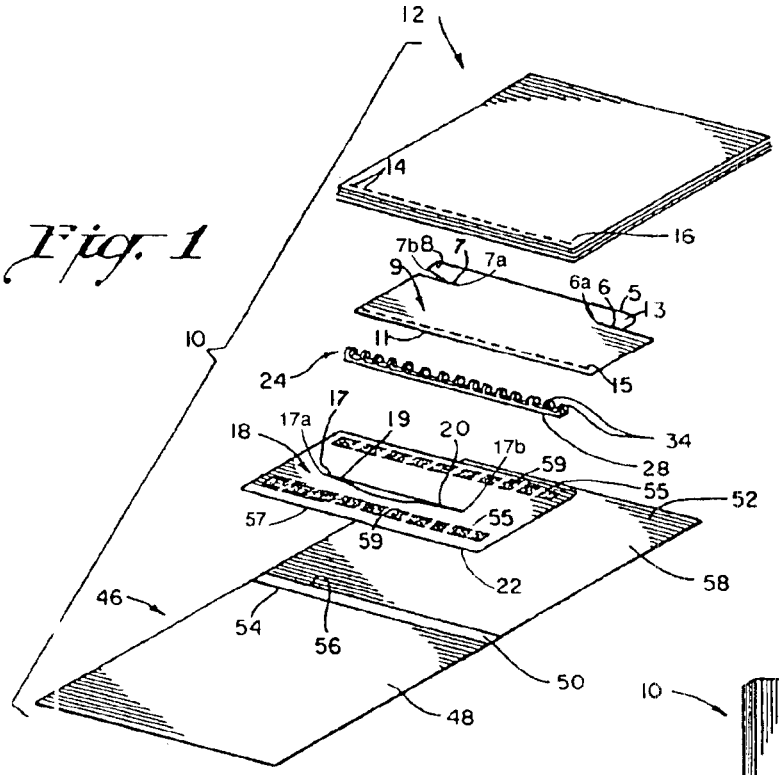
FIG. 1 is an exploded perspective view of the claimed invention.

Referring now to the drawings, the binding structure 10 illustrated in FIG. 1 is used for binding together sheets of paper or document 12 having multiple openings 14 along a margin 16 thereof that make up a document held within the binding structure 10. The binding structure 10 generally comprises a one-piece report cover 46, an elongated binding element 24, a male connector panel 09 and a female connector panel 18.

The male connector panel 09 has a rectangular shape with a straight edge 11 and a tab-shaped portion or edge 13. There are multiple openings 15 along the straight edge 11 that correspond to the openings 14 of the sheets of paper 12. The tab-shaped portion is defined by a lower locking notch 06 having a top end 06*a* and an upper locking notch 07 having a bottom end 07*a*. Preferably, a rounded corner 05 is cut in the tab shaped edge 13 adjacent the lower locking notch 06 and an angled corner 07*b* is cut adjacent the upper locking notch 07 to provide clearance for movement of the male connector panel 09 during assembly manipulation. The rounded corner 05 and angled corner 07*b* make the tab shaped edge 13 asymmetrical and require a person assembling the binding structure 10 to perform a number of steps in a particular order in order to assemble and disassemble the binding structure 10.

It is appreciated that there are several different types of structural configurations that can be designed to removably retain the male connector panel to the female connector panel such as the tab shaped edge 13 and aperture 17 design shown in FIG. 1. Therefore, it should be understood that other types of removable retention structures, such as the tab shaped edge 13 and aperture 17 design, requiring discrete assembly and disassembly manipulation are contemplated as being within the scope of the claimed invention. These other types of retention structures may include, but are not limited to reversal of the respective tab portion and aperture structures, utilizing temporary fasteners such as hook and loop type fasteners and using locking notch configurations at the top and bottom edges of the female connector panel.

An elongated binding element 24 is provided to bind the sheets of paper 12 and male connector panel 09 together. In one embodiment shown in FIGS. 4 and 5, the elongated binding element 24 is a flexible multiple ring binder or ring-type binder 26 of conventional design formed of plastic or metal and having a generally circular cross-section. The binder 26 generally includes a longitudinally extending rectangular back 28 having an outer convex surface 30 and an inner concave surface 32. A plurality of equally spaced apart semicircular flexible rings or binding members 34 are connected to the back 28 at one end with the opposite distal end 36 being used to penetrate the slots or multiple openings 14 of the sheets of paper 12. Punching and binding machines which are known in the art may be used in the binding process.

Figure 6:
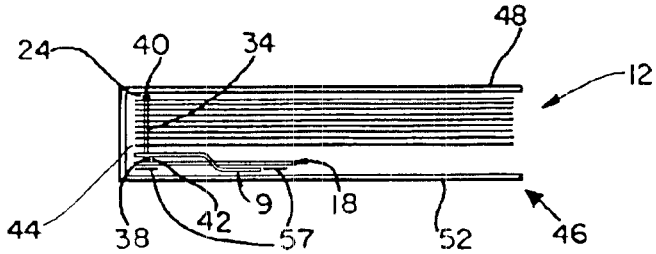
FIG. 6 is a side view of the claimed invention utilizing an alternative binding element in a closed position.
Figure 7:
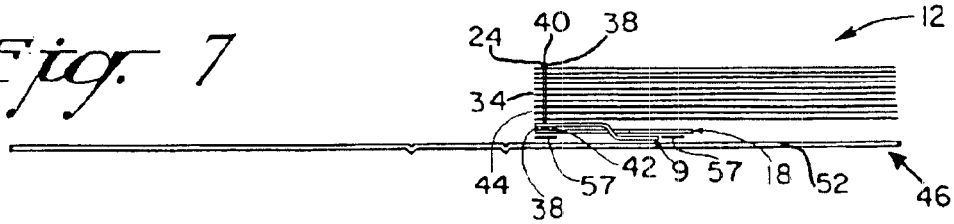
FIG. 7 is a side view of the claimed invention utilizing an alternative binding element in an open position.

Alternatively, the binding element 24 shown in FIGS. 6 and 7 may be a plastic bar and pin type binder 38 of the type known commercially as QUICKBIND or VELOBIND which includes a first thin elongated member 40 and a second thin elongated member 42. The second thin elongated member 42 has a plurality of apertures 44. The binding member 34 are elongated and pin shaped and connected to the first thin elongated member 40 with each of the binding members 34 extending through the openings in the sheets of paper 12 and female connector panel 18 and into a respective aperture 44 of the second thin elongated member 42.

Figure 4:
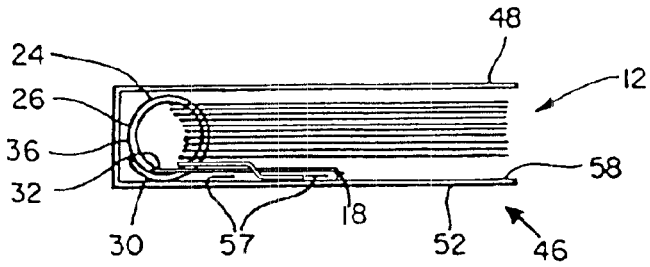
FIG. 4 is a side view of the claimed invention in a closed position.

After binding, the elongated binding element 24 will extend adjacent and parallel to the margin of the sheets of paper 12 and the straight male connector panel edge 11. The sheets of paper 12 and the male connector panel 09 are bound together with the male connector panel 09 being disposed on a bottom side of the elongated binding element 24, as shown in FIG. 4.

Referring to FIG. 1, a one-piece report cover 46 has a front panel 48, a center spine panel 50, and a back panel 52. The one-piece report cover 46 includes a first hinge 54 and a second hinge 56 parallel to the first hinge 54. The first hinge 54 and second hinge 56 are formed integral with the cover 46 and defining respectively pivotal connections between the front panel 48, the center spine panel 50, and the back panel 52. The cover 46, female connector panel 18 and male connector panel 09 are preferably formed of a stiff paper or cardboard, however, plastic or other materials could also be used. The hinges are formed by conventional methods such as scoring or creasing.

A pair of adhesive strips 55 of conventional type, such as two-sided adhesive tape, are provided which extend along a bottom side 57 of the female connector panel 18 for attaching the bottom side 57 of the female connector panel 18 to a front side 58 of the back panel 52 so that the elongated binding element 24 is disposed on the back panel 52 extending adjacent and parallel to the second hinge 56. Preferably, the strips 55 are positioned in a spaced apart relationship as shown in FIG. 1. The strip 55 which is closest to the first female connector panel edge 22 is in a spaced apart relationship from the edge 22 to allow for some flexibility in the female connector panel 18 and spacing from the back panel 52 to accommodate the raised level created by the binding element 24 and to allow the binding element 24 to move or pivot.

Figure 2:
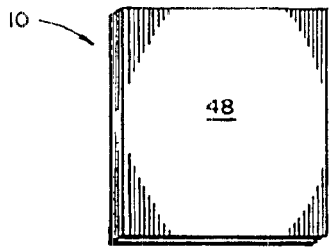
FIG. 2 is a perspective view of the claimed invention in a closed position.
Figure 3:
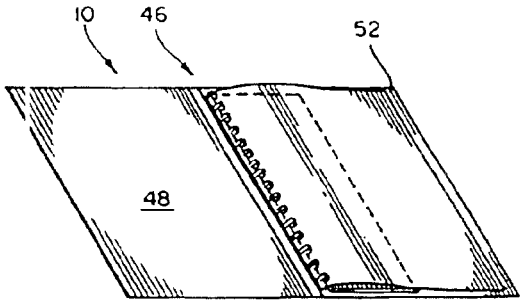
FIG. 3 is a perspective view of the claimed invention open to the first page.
Figure 3A:
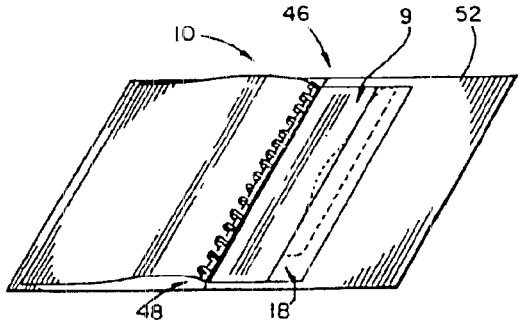
FIG. 3A is a perspective view of the claimed invention open to the last page.

A pair of nonstick protective strips 59 is connected to an outside surface of the adhesive strips 55 when the structure is in a non-assembled state, as shown in FIG. 1. The nonstick protective strips 59 are removed from the adhesive strips 55 when the structure is in an assembled state, as shown in FIG. 3. When assembled, the front panel 48 is pivotal along the first hinge 54 and second hinge 56 so that the front panel 48 is pivotally position able on top of the sheets of paper 12 when in a closed position, as shown in FIGS. 4 and 6. In FIG. 2, it can be seen that the structure 10 provides a binding system that conceals the elongated binding element 24 and has a professional appearance.

The female connector panel 18 has an aperture 17 which is cut out between the adhesive strips 55 in order that the upper "locking" corner 08 of the tab shaped edge 13 of the male connector panel 09 can be inserted, which will allow the tab shaped edge 13 of the male connecter panel 09 to lock in to place, thereby securing the document. During assembly of the male connector panel with the female connector panel, the top edge 17*a* of the aperture 17 engages the bottom end 07*a* of the upper locking notch 07 to retain the male connector panel in place. Similarly, the bottom edge 17*b* of the aperture 17 engages the top end 06*a* of the lower locking notch 06 to retain the male connector panel in place.

Once the adhesive strips 55 from the female connector panel 18 have been secured to the back panel 52 of the one-piece report cover 46 and the male connector panel 09 has been bound using the elongated binding element 24 to the sheets of paper 12, the tab shaped edge 13 of the male connector panel 09 is inserted in to the aperture 17 of the female connector panel 18 by a short manipulation process.

First the upper locking corner 08 of the tab shaped edge 13 of the male connector panel 09 is inserted at approximately a 30 degree angle in to the upper notch 19 of the small opening 17 of the female connector panel 18 in order that the upper locking corner 08 of the tab shaped edge 13 of the male connector panel 09 is placed underneath the bottom side 57 of the female connector panel 18. Once in place, the male connector panel 09 is pushed up so that the upper locking notch 07 on the tab shaped edge 13 of the male connector panel 09 slides in to the upper locking notch 19 of the small opening 17 in the female connector panel 18. This will lock the upper corner 08 of the male connector panel 09 underneath the bottom side 57 of the female connector panel 18. The male connector panel 09 is then rotated back to its original straight up and down orientation. The lower rounded locking corner 05 of the tab shaped edge 13 of the male connector panel 09 is placed underneath the bottom side 57 of the female connector panel 18.

At this point the entire tab shaped edge 13 of the male connector panel 09 should be completely inserted in to the small opening 17 of the female connector panel 18. From this position, the male connector panel 09 is pulled straight down until the lower locking notch 06 of the tab shaped edge 13 of the male connector panel 09 slides in to the lower locking notch 20 of the small opening 17 in the female connector panel 18. This will lock the lower rounded corner 05 of the male connector panel 09 underneath the bottom side 57 of the female connector panel 18. The tab shaped edge 13 is now locked in place underneath the bottom side 57 of the female connector panel 18. This will secure the sheets of paper 12 bound by the elongated binding element 24 to the male connector panel 09 inside the one-piece cover 46. To remove the document, slide the male connector panel 09 straight up, rotate the bottom of the tab shaped edge 13 out approximately 30 degrees and pull out of the small opening 17 on the angle until it has been separated.

Figure 5:
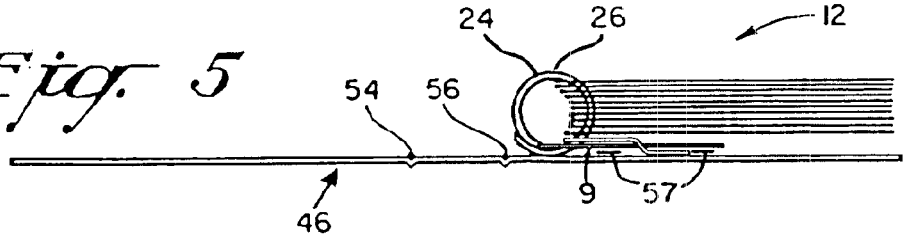
FIG. 5 is a side view of the claimed invention in an open position.

The front panel 48, the back panel 52, and the sheets of paper 12 are approximately parallel to one another allowing the structure to lay substantially flat when in the closed position, as illustrated in FIGS. 4 and 6, and substantially flat when in an open position when the front panel 48 is coplanar with the center spine panel 50 and the back panel 52, as illustrated in FIGS. 5 and 7. The previous features further aide in enhancing the professional appearance of the completely assembled report 10.

Figure 8:
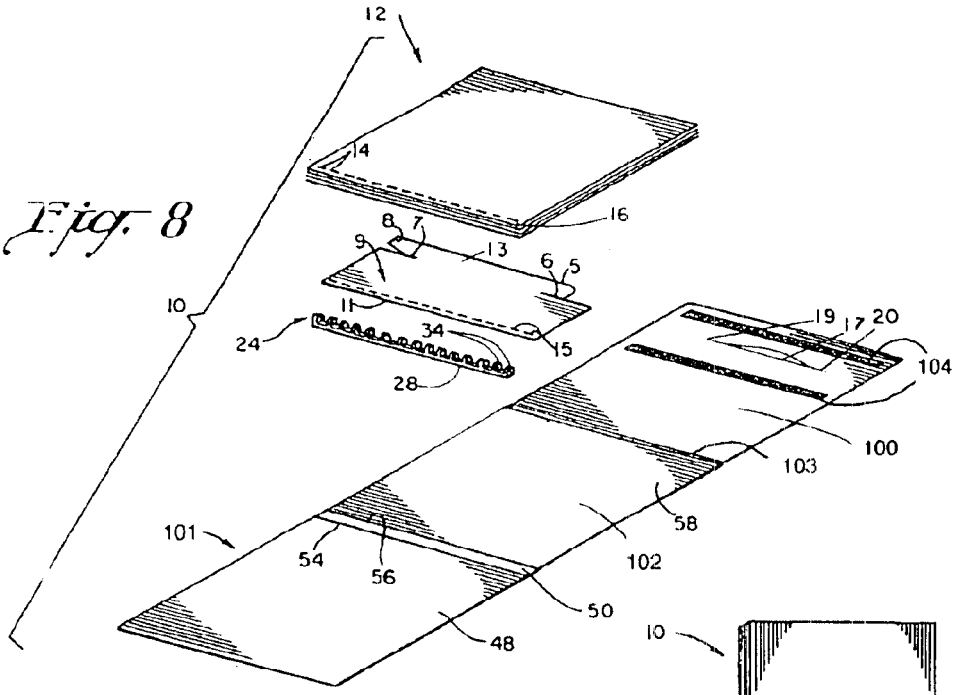
FIG. 8 is an exploded perspective view of another embodiment of the claimed invention.
Figure 9:
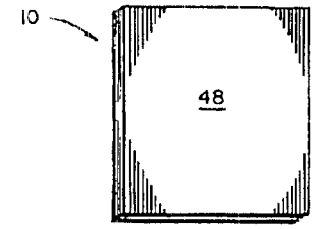
FIG. 9 is a perspective view of another embodiment of the claimed invention in a closed position.
Figure 10:
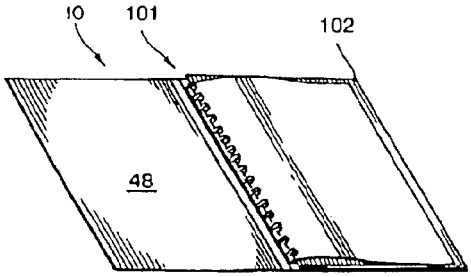
FIG. 10 is a perspective view of another embodiment of the claimed invention open to the first page.
Figure 11:
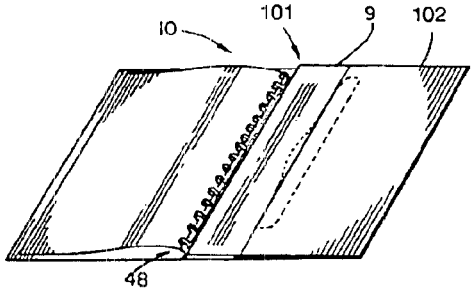
FIG. 11 is a perspective view of another embodiment of the claimed invention open to the last page.
Figure 12:
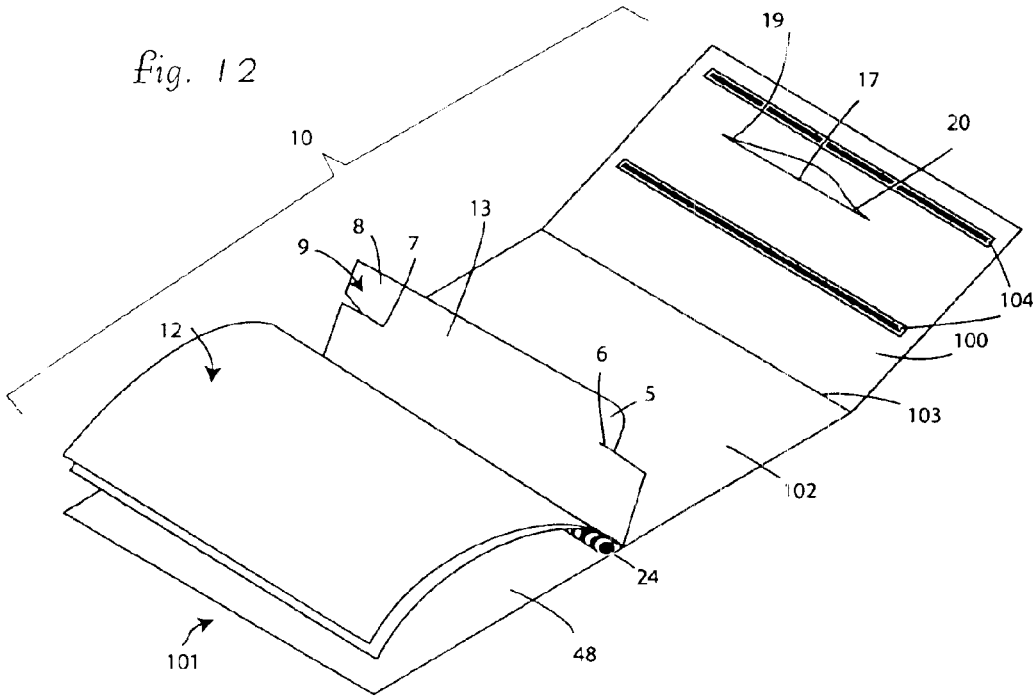
FIG. 12 is a perspective view illustrating an assembly step of the binding structure of FIG. 8.
Figure 13:
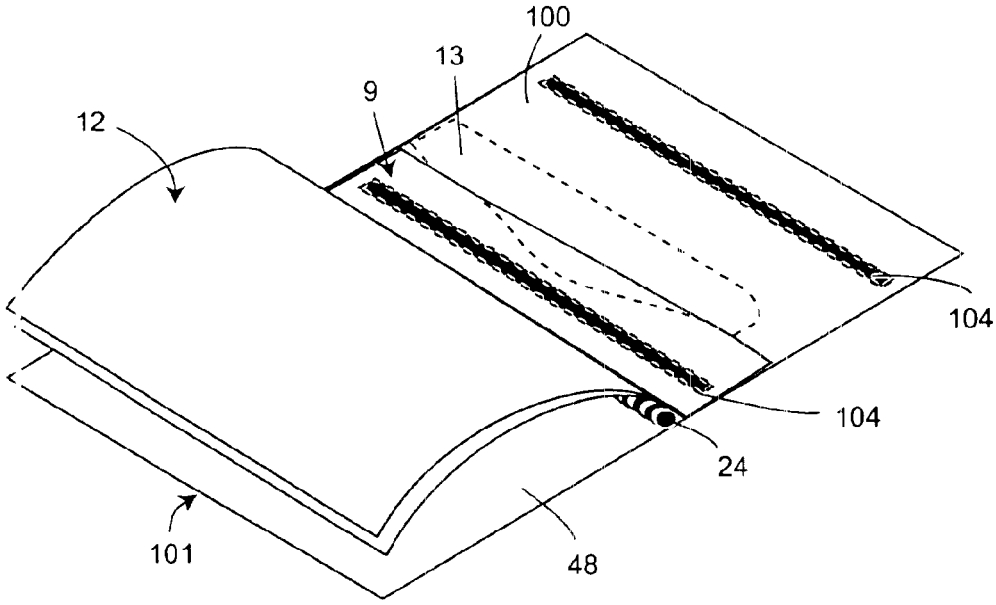
FIG. 13 is a perspective view of the assembled binding structure of FIG. 8.
Figure 14:
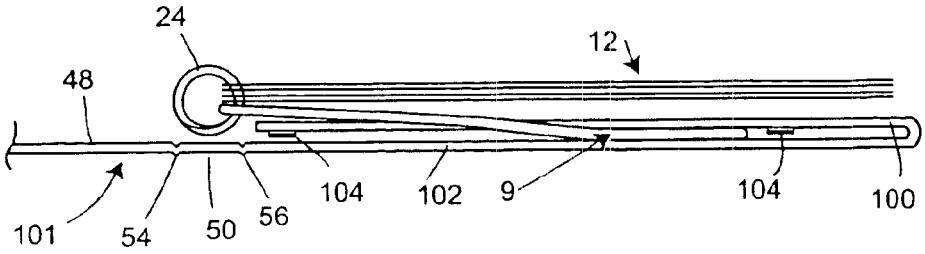
FIG. 14 is a side view of the assembled binding structure of FIG. 8.
Figure 15:
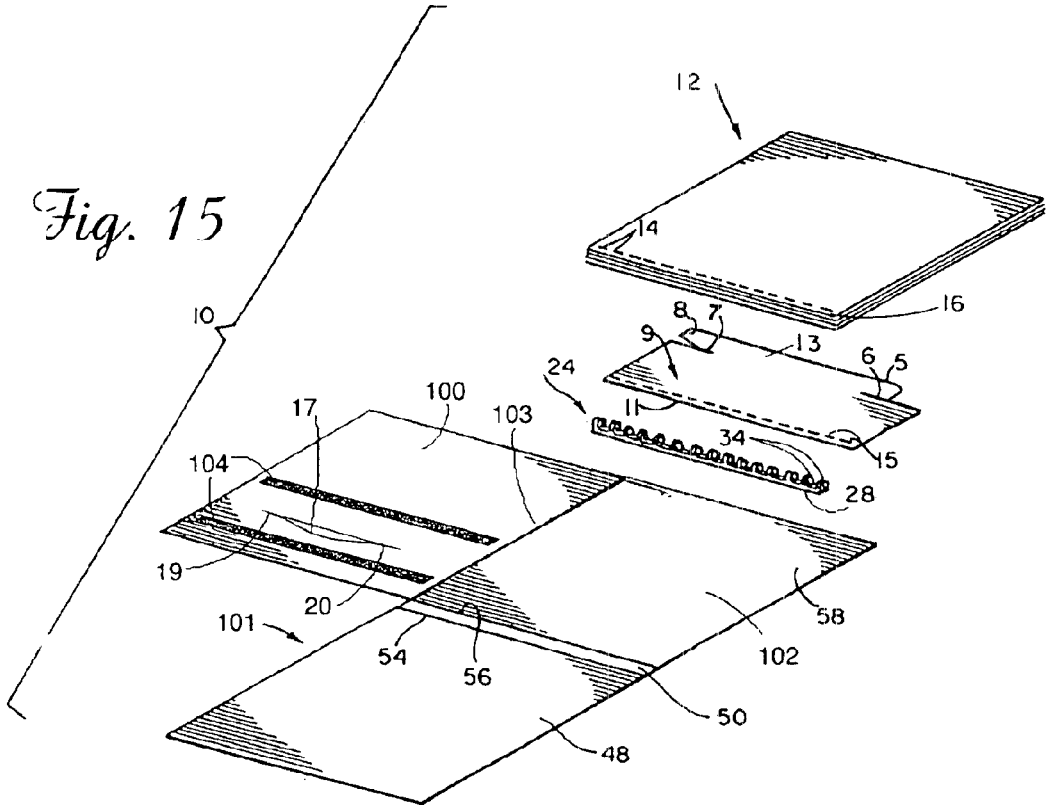
FIG. 15 is an exploded perspective view of a further embodiment of the claimed invention where the female connector panel is hingedly connected to a top edge of the back panel.
Figure 16:
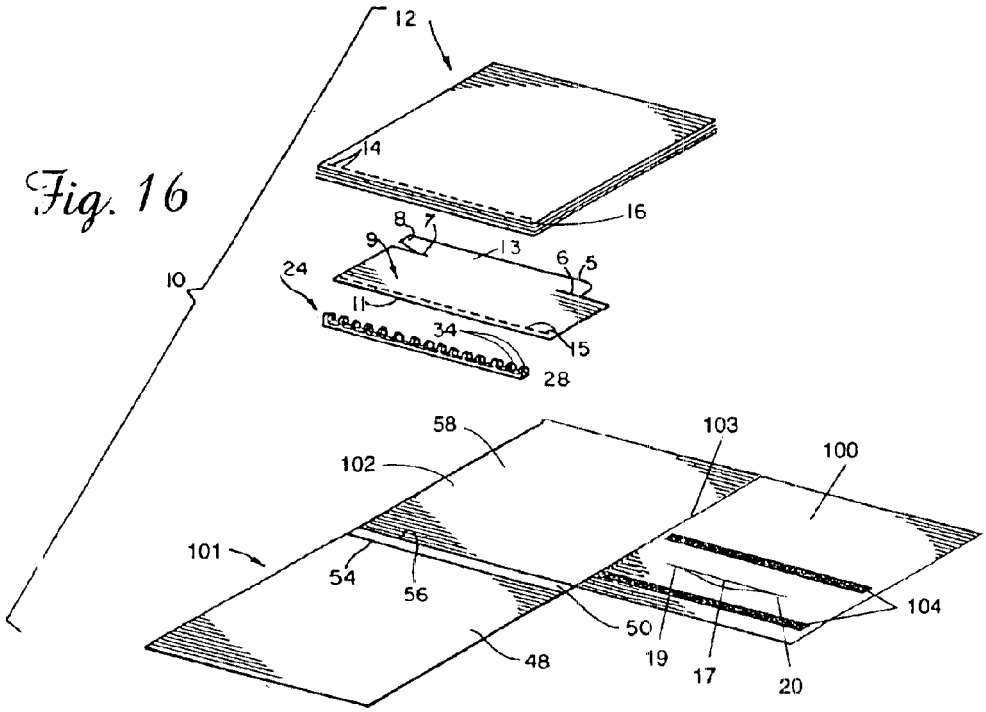
FIG. 16 is an exploded perspective view of an even further embodiment of the claimed invention where the female connector panel is hingedly connected to a bottom edge of the back panel.

In another embodiment of the claimed invention, the female connector panel 100 is an integral part of the one-piece report cover 101 as shown in FIG. 8 where the female connector panel 100 is connected to the back panel 102 by an additional hinge 103 that is integrally made by known methods such as scoring or creasing. During assembly of a binding structure of this type, the female connector panel 100 is pivoted about the hinge 103 connecting the female connector panel 100 to the back panel 102 so that the adhesive strips 104 may be adhered to the back panel 102 as shown in FIG. 9 creating the structure for retaining the tab shaped portion of the male connector panel within the aperture of the female connector panel as shown in FIG. 10. This hinge 103 may be on any of the three sides of the back panel 102 of the one-piece report cover 101, either off the right-facing side as in FIGS. 8–14, off the top side of the back panel 102 as in FIG. 15 or off the bottom side of the back panel 102 as in FIG. 16.

Although the invention has been described by reference to some embodiments it is not intended that the novel device be limited thereby, but that modifications thereof are intended to be included as falling within the broad scope and spirit of the foregoing disclosure, the following claims and the appended drawings.

We claim:

1. A binding structure for binding together sheets of paper, the structure comprising:

an elongated binding element having a plurality of binding members;

a male connector panel having a plurality of binding apertures therethrough along one edge for engaging the binding members of the elongated binding element with an upper locking notch and a lower locking notch defining a tab shaped portion;

a report cover having a back panel;

a female connector panel having an aperture therethrough sized for retaining the tab shaped portion of the male connector panel beneath the female connector panel when the upper locking notch and lower locking notch engage the aperture of the female connector panel disposing the binding apertures of the male connector panel above the female connector panel; and fastening means for fastening the female connector panel to the back panel of the report cover.

2. The binding structure of claim 1 wherein the tab shaped portion has a rounded corner adjacent the lower locking notch providing clearance for movement of the male connector panel with respect to the female connector panel during assembly.

3. The binding structure of claim 2 wherein the tab shaped portion has an angled corner adjacent the upper locking notch providing clearance for movement of the male connector panel with respect to the female connector panel during assembly.

4. The binding structure of claim 2 wherein the tab shaped portion has an angled corner adjacent the upper locking notch providing clearance for movement of the male connector panel with respect to the female connector panel during assembly.

5. The binding structure of claim 3 wherein the fastening means includes adhesive.

6. The binding structure of claim 5 wherein the elongated binding element is a ring-type binder having a generally circular cross-section, the binding members being semicircular flexible rings.

7. The binding structure of claim 4 wherein the fastening means includes adhesive.

8. The binding structure of claim 7 wherein the elongated binding element is a ring-type binder having a generally circular cross-section, the binding members being semicircular flexible rings.

9. A binding structure for binding together sheets of paper having multiple connector panels connecting an elongated binding element to a one-piece report cover where a male connector panel bound to the elongated binding element has removable retention structure removably retained by a female connector panel fastened to a back panel of the one-piece report cover, the removable retention structure providing means for disassembly of the connector panels by discrete disassembly manipulation.

10. The binding structure of claim 9 wherein the removable retention structure comprises an aperture through the female connector panel retaining a tab portion of the male connector panel shaped to release retention of the tab portion by systematic adverse directional manipulations.

11. The binding structure of claim 10 wherein the tab portion of the male connector panel comprises asymmetrical corners determining sequence of the systematic adverse directional manipulations.

12. The binding structure of claim 11 wherein the elongated binding element is a ring-type binder with semicircular flexible rings and the female connector panel is fastened to the back panel of the one-piece report cover by adhesive.

13. The binding structure of claim 12 wherein the adhesive is positioned on the female connector such that the tab portion of the male connector panel may lie beneath the female connector panel.

14. A method of assembling a document and a paper binding structure having multiple piece connector panels comprising the steps of:

engaging binding members of an elongated binding element with a plurality of apertures along a first edge of a male connector panel;

engaging the binding members of the elongated binding element with a plurality of apertures along an edge of a document;

inserting an upper locking corner of the male connector panel at an angle through an aperture of a female connector panel such that the upper locking corner lies beneath the female connector panel;

rotating the male connector panel such that an upper locking notch in the male connector panel engages an edge of the aperture through the female connector panel;

moving the male connector panel such that a bottom end of the upper locking notch contacts the edge of the aperture through the female connector panel;

inserting a lower locking corner of the male connector panel through the aperture of the female connector panel; and moving the male connector panel such that a top end of the lower locking notch contacts a second edge of the aperture through the female connector panel.

15. The method of claim 14 further comprising the step of adhering the female connector panel to a back panel of a report cover.

16. A binding structure for binding together sheets of paper, the structure comprising:

an elongated binding element having a plurality of binding members;

a male connector panel having a plurality of binding apertures therethrough along one edge for engaging the binding members of the elongated binding element with an upper locking notch and a lower locking notch defining a tab shaped portion;

a one-piece report cover having a front panel, a back panel, and a female connector panel integral hingedly connected to the back panel, the female connector panel having an aperture therethrough sized for retaining the tab shaped portion of the male connector panel beneath the female connector panel when the upper locking notch and lower locking notch engage the aperture of the female connector panel; and fastening means for fastening the female connector panel to the back panel of the report cover.

17. The binding structure of claim 16 wherein the tab shaped portion has a rounded corner adjacent the lower locking notch providing clearance for movement of the male connector panel with respect to the female connector panel during assembly.

18. In a one-piece report cover having a front panel, a back panel, an elongated binding element with binding members, and a connector panel connected to the back panel having multiple openings engaged with the binding members of the elongated binding element, wherein the improvement comprises:

a male connector panel having a plurality of binding apertures therethrough along one edge for engaging the binding members of the elongated binding element with an upper locking notch and a lower locking notch defining a tab shaped portion; and a female connector panel having an aperture therethrough sized for retaining the tab shaped portion of the male connector panel beneath the female connector panel when the upper locking notch and lower locking notch engage the aperture of the female connector panel disposing the binding apertures of the male connector panel above the female connector panel.

19. The binding structure of claim 18 wherein the tab shaped portion has a rounded corner adjacent the lower locking notch providing clearance for movement of the male connector panel with respect to the female connector panel during assembly.

20. The binding structure of claim 19 wherein the tab shaped portion has an angled corner adjacent the upper locking notch providing clearance for movement of the male connector panel with respect to the female connector panel during assembly.

21. In a one-piece report cover having a front panel, a back panel, an elongated binding element with binding members, and a connector panel connected to the back panel having multiple openings engaged with the binding members of the elongated binding element, wherein the improvement comprises:

a first connector panel having a plurality of binding apertures therethrough along one edge for engaging the binding members of the elongated binding element with first removable retention structure; and a second connector panel fastened to the back panel of the one-piece report cover has second removable retention structure for engagement with the first removable retention structure of the first connector panel, the first and second removable retention structures providing means for disassembly of the connector panels by discrete disassembly manipulation.

22. The improvement of claim 21 wherein the first removable retention structure comprises an upper locking notch and a lower locking notch defining a tab shaped portion.

23. The improvement of claim 22 wherein the second removable retention structure comprises an aperture through the second connector panel sized fro retaining the tab shaped portion of the male connector panel beneath the female connector panel when the upper locking notch and lower locking notch engage the aperture of the second connector panel.

24. The improvement of claim 23 wherein the first connector panel further comprises a rounded corner adjacent the lower locking notch providing clearance for movement of the first connector panel with respect to the second connector panel during assembly.

25. The improvement of claim 24 wherein the second connector panel further comprises an angled corner adjacent the upper locking notch providing clearance for movement of the first connector panel with respect to the second connector panel during assembly.

* * * * *